US006726278B1

(12) United States Patent
Albright et al.

(10) Patent No.: US 6,726,278 B1
(45) Date of Patent: Apr. 27, 2004

(54) BACK PAD FOR CHAIR BACK

(75) Inventors: Scott Albright, Lexington, SC (US); Lance Lindenberg, Lavergne, TN (US)

(73) Assignee: First Source Furniture Group LLC, Nashville, TN (US)

( * ) Notice: Subject to any disclaimer, the term of this patent is extended or adjusted under 35 U.S.C. 154(b) by 0 days.

(21) Appl. No.: 10/460,957

(22) Filed: Jun. 13, 2003

(51) Int. Cl.[7] ..... A47C 7/40

(52) U.S. Cl. ..... 297/218.1; 297/228.1; 297/218.2

(58) Field of Search ..... 297/218.1, 219.1, 297/228.1, 440.11, 440.2, 218.2

(56) References Cited

U.S. PATENT DOCUMENTS

| | | | | |
|---|---|---|---|---|
| 1,116,041 | A | | 11/1914 | Durant |
| 3,288,529 | A | * | 11/1966 | Koch ..... 297/440.2 |
| 3,348,880 | A | | 10/1967 | Swann |
| 3,504,941 | A | | 4/1970 | Gerard |
| 3,669,499 | A | * | 6/1972 | Semplonius et al. ... 297/452.14 |
| 4,036,524 | A | | 7/1977 | Takamatsu |
| 4,065,182 | A | * | 12/1977 | Braniff et al. ..... 297/440.22 |
| 4,232,898 | A | | 11/1980 | Bodrero |
| 4,420,186 | A | | 12/1983 | Vogt |
| 5,281,002 | A | | 1/1994 | Dauphin |
| 5,318,346 | A | * | 6/1994 | Roossien et al. ..... 297/300.1 |
| 5,709,431 | A | | 1/1998 | Horn |
| 5,806,925 | A | | 9/1998 | Hanley |
| 5,816,654 | A | | 10/1998 | Ellis |
| D422,802 | S | | 4/2000 | Deacon |
| 6,206,468 | B1 | | 3/2001 | Brosnan et al. |
| 6,220,661 | B1 | * | 4/2001 | Peterson ..... 297/218.4 |
| 6,257,665 | B1 | * | 7/2001 | Nagamitsu et al. ..... 297/285 |
| 6,382,719 | B1 | | 5/2002 | Heidmann et al. |
| 6,499,801 | B1 | * | 12/2002 | Peterson et al. ..... 297/228.13 |

FOREIGN PATENT DOCUMENTS

DE 33 21 410 A1 12/1984

OTHER PUBLICATIONS

Keilhauer internet "Product Pages" regarding "TOM" chair 2003. (4 pages).

* cited by examiner

*Primary Examiner*—Peter R. Brown
(74) *Attorney, Agent, or Firm*—Flynn, Thiel, Boutell & Tanis, P.C.

(57) ABSTRACT

A back pad for a chair having a back defined by a shell, the back pad being fitted over the back shell and providing the back with a resilient padded feel while additionally providing styling flexibility with respect to the appearance of the chair back.

20 Claims, 11 Drawing Sheets

BACK PAD FOR CHAIR BACK

FIELD OF THE INVENTION

This invention relates to a chair as typically used in offices and the like and, more specifically, to an improved back pad which can be optionally attached to the chair back to provide altered comfort and appearance.

BACKGROUND OF THE INVENTION

Chairs, and particularly office-type chairs, are conventionally provided with either a shell-like back or an upholstered back. In a chair with a shell-like back, the back is conventionally formed of a molded plastics material having limited resiliency or flexibility, and any aesthetics or decorative styling are typically achieved solely by coloration and shape. While chairs of this type are acceptable in some applications, nevertheless in many applications they do not provide the degree of cushioned resiliency frequently desired or expected. For this reason many office chairs employ a cushioned back wherein the back includes an inner supportive shell having a suitable deformable cushioning layer thereover, which cushioning layer is enclosed by a flexible covering such as fabric or vinyl. Such cushioned back construction provides a higher degree of cushioned comfort as desired in many use applications, but at the same time such construction is more expensive.

In an effort to provide increased manufacturing efficiency and flexibility with respect to providing a chair permitting use with both a shell back and a cushioned back, one prior chair as manufactured by Keilhauer and known as the "Tom" chair employs a back defined by a one-piece plastic shell having a large plurality of small openings therethrough disposed in a grid-like pattern, which shell back enables the chair to be used for direct supportive engagement with the chair occupant. In an effort to provide improved chair flexibility, the aforementioned chair can also be provided with a back pad which removably attaches to the back shell in overlying relationship to the front face thereof. This back pad employs a plastic shell with a foam layer thereover which in turn is enclosed within an outer covering. The back pad secures to the back shell by screws which extend through holes located in the corners of the back shell for engagement with aligned holes associated with the corners of the back pad. When the back pad is mounted on the back shell, there is provided a more resilient and deformable back construction for user comfort. The back pad does provide limited styling, except that the pad effectively covers only an upper portion of the back shell and provides no covering over the waist portion of the back shell. Furthermore, the securement of the back pad to the back shell by screws requires that the back shell have openings therethrough, and providing such openings is in many instances considered unacceptable from a styling standpoint, particularly when the chair is utilized without the back pad mounted thereon.

Accordingly, it is an object of this invention to provide an improved chair having a back defined by a back shell which can be utilized without an upholstered or cushioned covering thereover, but which can optionally be provided with an upholstered resilient back pad which can be readily and easily fitted over the back shell, either at the factory or retrofitted at the job site, so as to provide the back with a resilient padded feel while additionally providing styling flexibility with respect to the appearance of the back.

It is also an object of the present invention to provide an improved chair, as aforesaid, wherein the back pad incorporates as an integral part thereof an upward extension which, when the back pad mounts to the back shell, projects upwardly above the back shell to function as a head rest, thereby converting the chair from one having a normal height back to one having a higher height back.

It is also an object of the present invention to provide an improved chair back, as aforesaid, wherein the back pad can be readily fitted to the back shell by means of flanges on the back pad which overlie the top and side edges of the back shell so that the back pad can be effectively fitted downwardly over the back shell to effect secure engagement therewith, thereby permitting the back pad to be easily and securely mounted on the back shell without requiring use of threaded fasteners or the like, whereby the back shell at least throughout the principal visible portion thereof can be free of fastener openings and the like.

In the improved chair of this invention, the chair includes a back arrangement which projects upwardly from adjacent a rear edge of the seat. The back arrangement is defined principally by a one-piece back shell constructed of a thin plastics material so as to have the desired contour and preferably at least limited resiliency or flexibility, whereby the back shell can directly function as the exposed back of the chair for direct supportive contact with the chair occupant. The chair can optionally be provided with a preassembled back pad unit which can be provided on the chair at the time it is shipped from the factory, or can subsequently be retrofitted onto the chair, to provide the chair with a more conventional cushioned back covered with a fabric or covering. The preassembled back pad unit has its own thin shell, again preferably a thin plastic sheet of suitable shape and contour formed similar to the main back shell so as to be positionable directly over the front face of the main back shell. The pad shell has a thin cushioned layer overlying and secured to the front face thereof, and a flexible outer covering encloses the front side of the pad unit and wraps therearound for fixed securement to the back side of the pad shell. The flexible covering has a top flap portion which wraps around the upper edge of the pad shell and is sized sufficiently so as to define a downwardly opening pocket portion where the covering overlies the back side of the pad shell. The pad shell also has upper and opposed side mounting flanges, all positioned so as to be disposed under the upper fabric portion which defines the rear pocket, so that the pad unit can be fixedly secured to the back shell by being slidably inserted downwardly over the upper edge thereof so that the flanges of the pad shell securely engage and embrace the back shell along the upper and opposed side edges thereof, and the flap portion defining the rear pocket overlies the upper rear side of the back shell.

In the improved chair of this invention, as aforesaid, the pad unit in an alternate construction has the pad shell provided with an upper headrest extension which projects upwardly a selected distance above the upper mounting flanges. The cushioning layer and the covering layer all extend upwardly and enclose this upward extension such that the pad unit, when mounted on the back shell, effectively defines a headrest extension which projects upwardly above the upper edge of the back shell to convert the back arrangement into a high-height back.

Other objects and purposes of the invention, including structural and operational advantages thereof, will be apparent to persons familiar with constructions of this general type upon reading the following specification and inspecting the accompanying drawings.

BRIEF DESCRIPTION OF THE DRAWINGS

FIG. 10 is a top view of the pad shell shown in FIG. 7.

Figure 1:
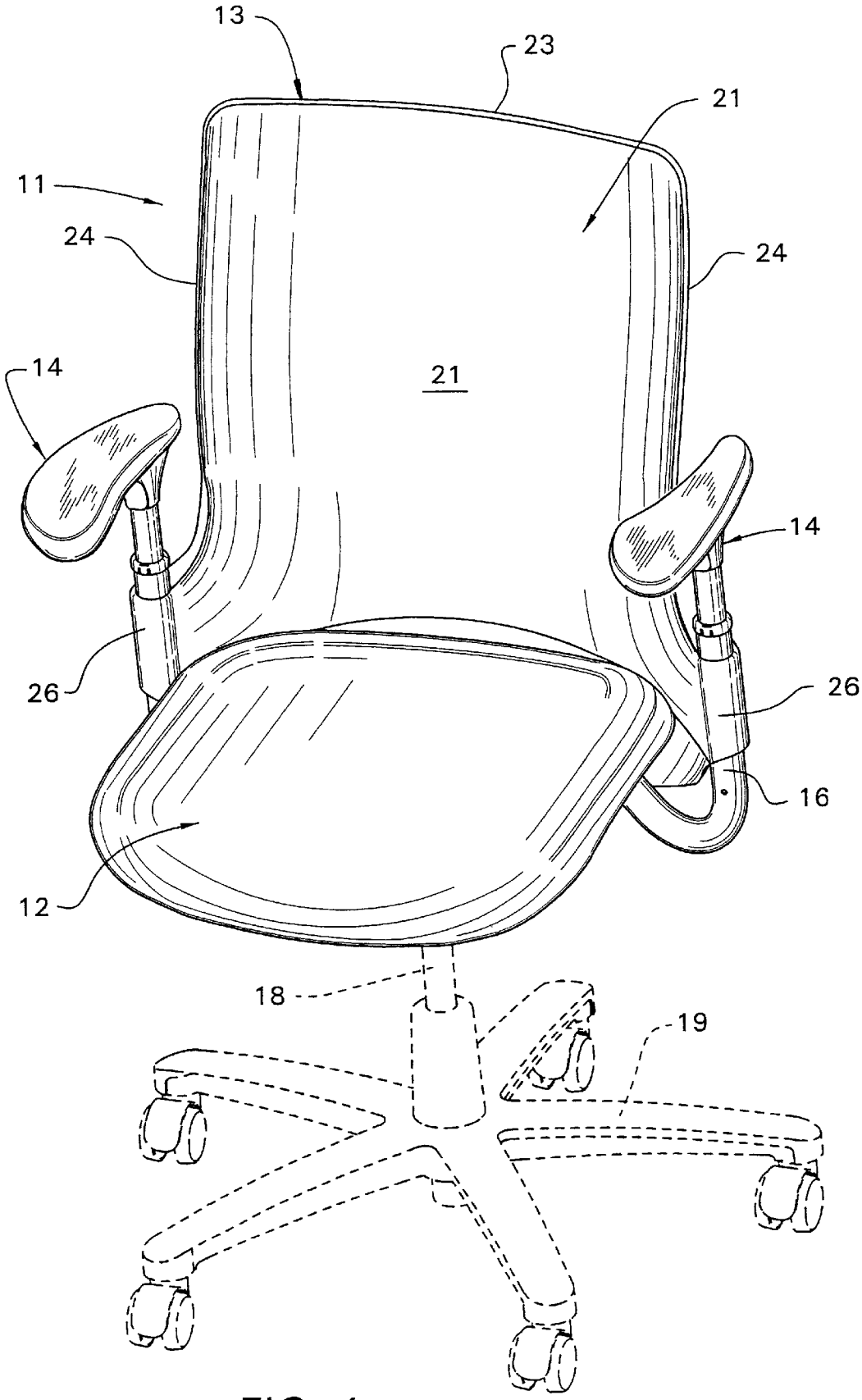
FIG. 1 is a perspective view of a chair having a back defined by an unupholstered back shell.

Certain terminology will be used in the following description for convenience in reference only, and will not be limiting. For example, the words "upwardly", "downwardly", "rightwardly" and "leftwardly" will refer to directions as appearing in the drawings, and will also refer to the same directions with respect to an occupant seated in the chair. The words "front" and "rear" will refer to directions with respect to an occupant seated in the chair. The words "inwardly" and "outwardly" will refer to the geometric center of the chair and designated parts thereof. Said terminology will include the words specifically mentioned, derivatives thereof, and words of similar import.

DETAILED DESCRIPTION

Referring to FIG. 1, there is illustrated a chair 11 of the type conventionally used in offices and the like. The chair 11 includes a seat 12 which projects forwardly from an upwardly projecting back 13. A pair of arm rest assemblies 14 are movably supported on uprights 16 which project upwardly from adjacent opposite sides of the seat 12. A conventional chair control arrangement (not shown), which typically defines a generally horizontal tilt axis, connects the seat 12 to the upper end of an upright pedestal 18, the latter typically having a height adjusting air spring associated therewith. The pedestal 18 at its lower end couples to a conventional base 19, the latter typically having a plurality of radially outwardly projecting legs provided with casters adjacent the outer ends thereof.

The back 13 in the illustrated chair 11 is defined principally by a monolithic one-piece back member or shell 21 which is typically formed of a synthetic resin material such as a plastics material. This one-piece back member 21 includes a main upright panel 22 which defines the dominant horizontal and vertical extent of the chair back for supportive engagement with the back of a seated occupant. The main panel 22 extends vertically from an upper edge 23 downwardly to a lower edge which is typically disposed in the vicinity of the rear edge of the seat 12, and also extends horizontally between opposite side edges 24. The back shell 21 in the illustrated chair also includes mounting sleeves 26 which are fixedly joined to and project outwardly from opposite sides of the main panel 22 for coupling, and more specifically slidably supporting, the back member 21 to the arm uprights 16. A suitable latching mechanism is preferably provided for cooperation between the mounting sleeves and the arm uprights to permit height adjustment of the back member.

The construction of the chair 11 is described in grater detail in copending application Ser. No. 10/267,422, filed on Sep. 11, 2003, as owned by the assignee hereof and entitled "HEIGHT-ADJUSTABLE CHAIR BACK" (Atty. Ref. FSFG Case 21). The disclosure of this latter copending application is incorprated herein by reference.

According to the present invention, there is provided a preassembled pad unit 31 (FIGS. 2–6) which can be optionally mounted on the back shell 21 to provide the chair back with a more conventional upholstered appearance and feel.

The pad unit 31 has its own support panel or shell 32 which is preferably formed as a relatively thin plastic sheet of suitable shape and contour, and which is preferably formed similar to the shape and contour of the chair back shell 21 so that the pad shell 32 can be directly positioned over the front face of the chair back shell 21.

The pad support shell 32 has a thin cushioning layer such as a foam layer 34 overlying the front side 33 and secured thereto as by an adhesive. An outer flexible covering 36 such as a flexible sheet of fabric or vinyl overlies the foam cushion layer 34 to totally enclose the front side of the pad unit. This covering 36 has side edge parts 39 and a lower edge part 41 which wrap around the side and bottom edges of the cushioning layer 34 and support shell 32 so as to overlie and are fixedly secured, as by stapling or the like, to the back surface of the support shell 32. The flexible covering 36 also has a top portion 42 which wraps around the upper edge of the cushion layer 34 and support shell 32 and projects downwardly behind the back surface of the support shell 32. This top edge portion or flap 42 of the flexible covering is sufficiently sized so that, when it wraps around the upper edge and overlies the back surface of the support shell, it defines a downwardly opening pocket 43 between the flap 42 and the rear surface of the support shell 32, which pocket opens upwardly from the lower free edge 44 of the flap. The vertical sides of the folded over flap 42 are secured, as by stitching, to the main front covering panel 37 generally along the vertical sides of the pad unit.

The pad shell 32, as illustrated by FIGS. 7–10, is a one-piece sheetlike member, such as a thin sheet molded of a plastics material, and extends vertically between respective upper and lower edges 51 and 52, and horizontally between opposite edges 53. The side edges 53 in the illustrated arrangement include upper side edge portions 54 which project downwardly from the upper edge 51 through a limited distance, and which in the illustrated arrangement are approximately parallel. These upper side edge portions 54 in turn join to lower side edge portions 56 which in the illustrated arrangement taper slightly inwardly in converging relationship with respect to one another as they project downwardly toward the lower edge 52.

The pad shell 32 has a pair of rearwardly and downwardly projecting top securing flanges 57 disposed in spaced relationship along the top edge 51 thereof. A pair of similar opposed side securing flanges 58 are associated with the opposite side edge portions 54 and project rearwardly and inwardly of the panel shell 32 in opposed relationship to one another. The flanges 57 and 58 each cooperate with the back side of the pad shell 32 so as to effectively define a slot for accommodating therein an edge of the chair back shell 21, as discussed hereinafter. These top and side flanges 57–58 are preferably formed as an integral and monolithic part of the shell pad 32. The flanges 57–58 are also positioned so as to be associated with an upper portion of the pad shell 32 such that they are positioned upwardly from the lower free edge 44 of the pocket flap 42 so as to be covered by the pocket flap 42.

Figure 11:
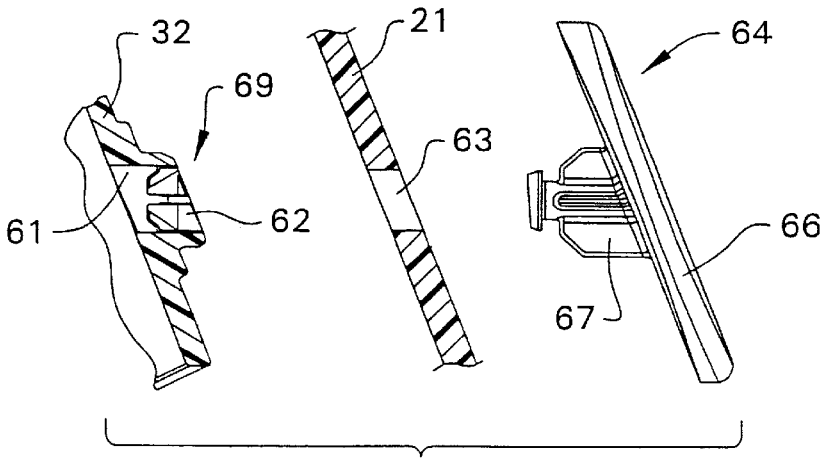
FIG. 11 is an exploded fragmentary view illustrating the manner in which the pad unit, adjacent the lower end thereof, attaches to the back shell.
Figure 9:
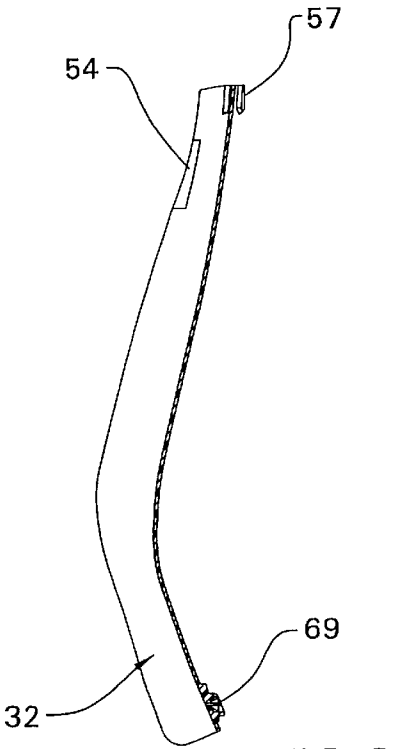
FIG. 9 is a sectional view taken along line 9—9 in FIG. 7.
Figure 8:
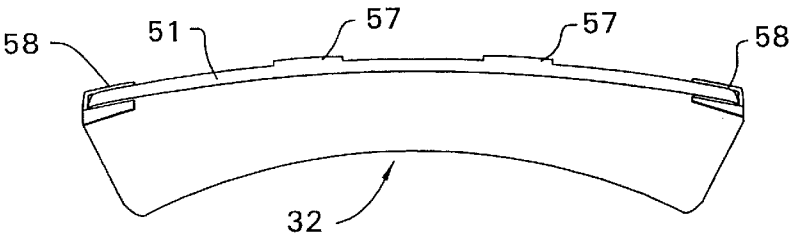
FIG. 8 is a top view of the pad shell shown in FIG. 7.
Figure 7:
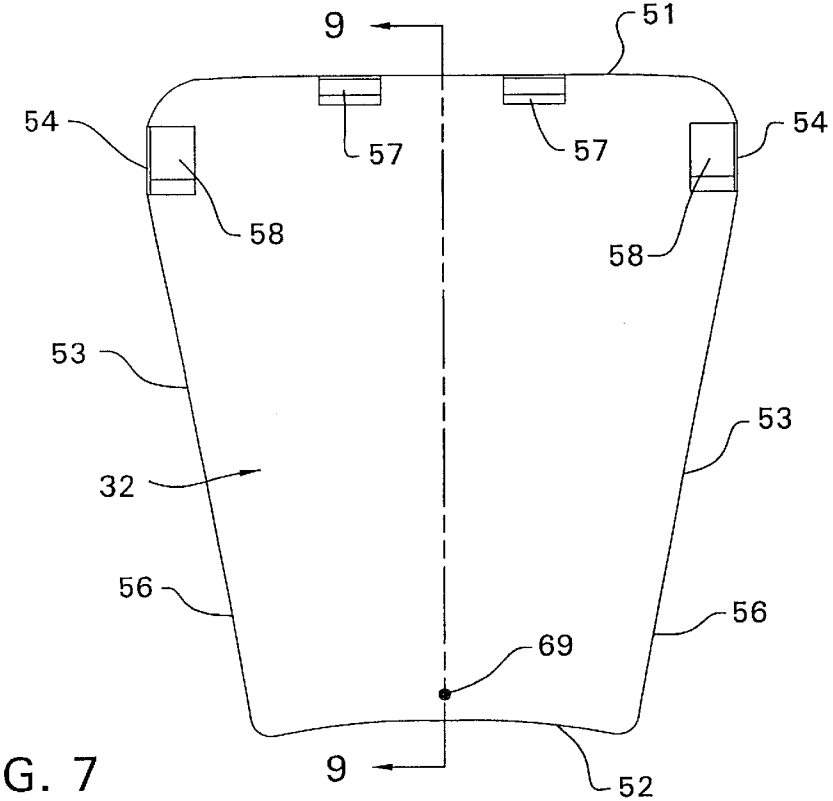
FIG. 7 is a front elevational view of the pad shell associated with the pad unit.
Figure 10:
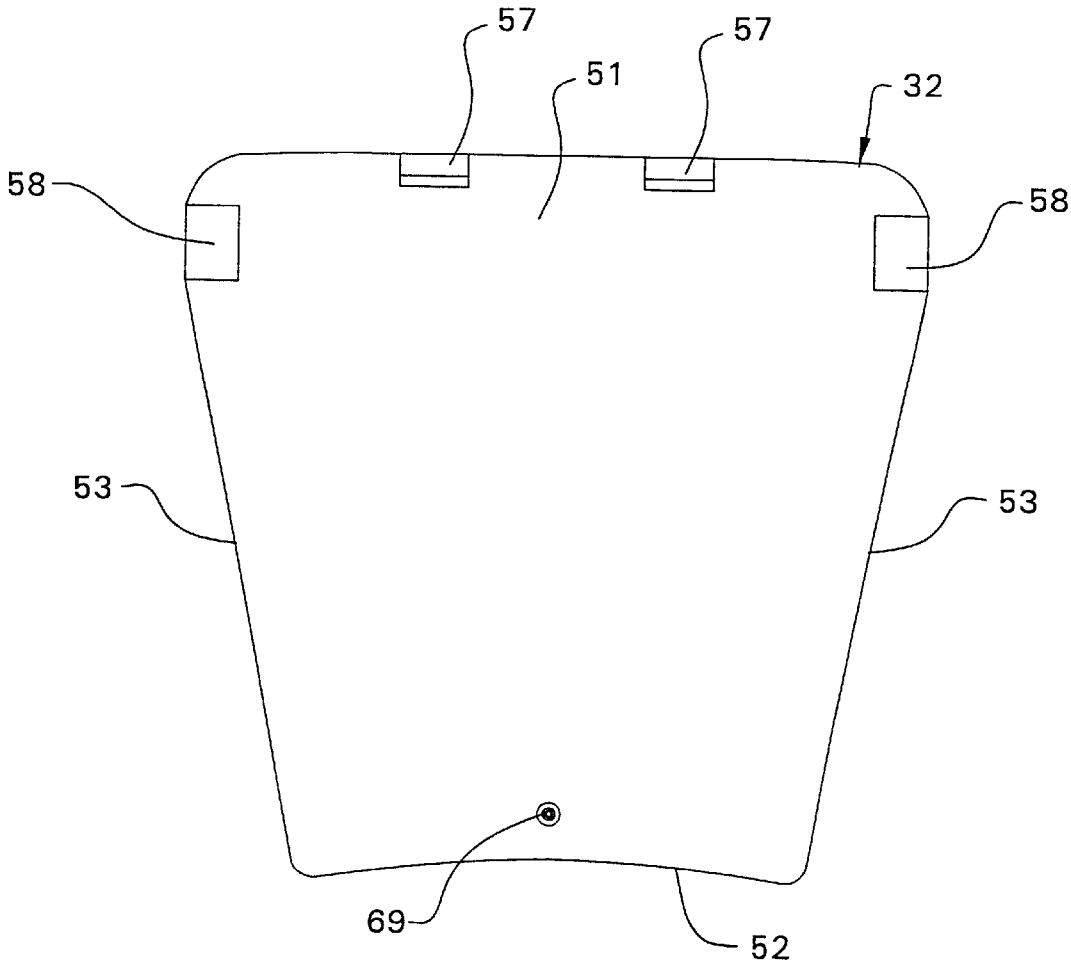
FIG. 10 is a back elevational view of the pad shell shown in FIG. 7.
Figure 12:
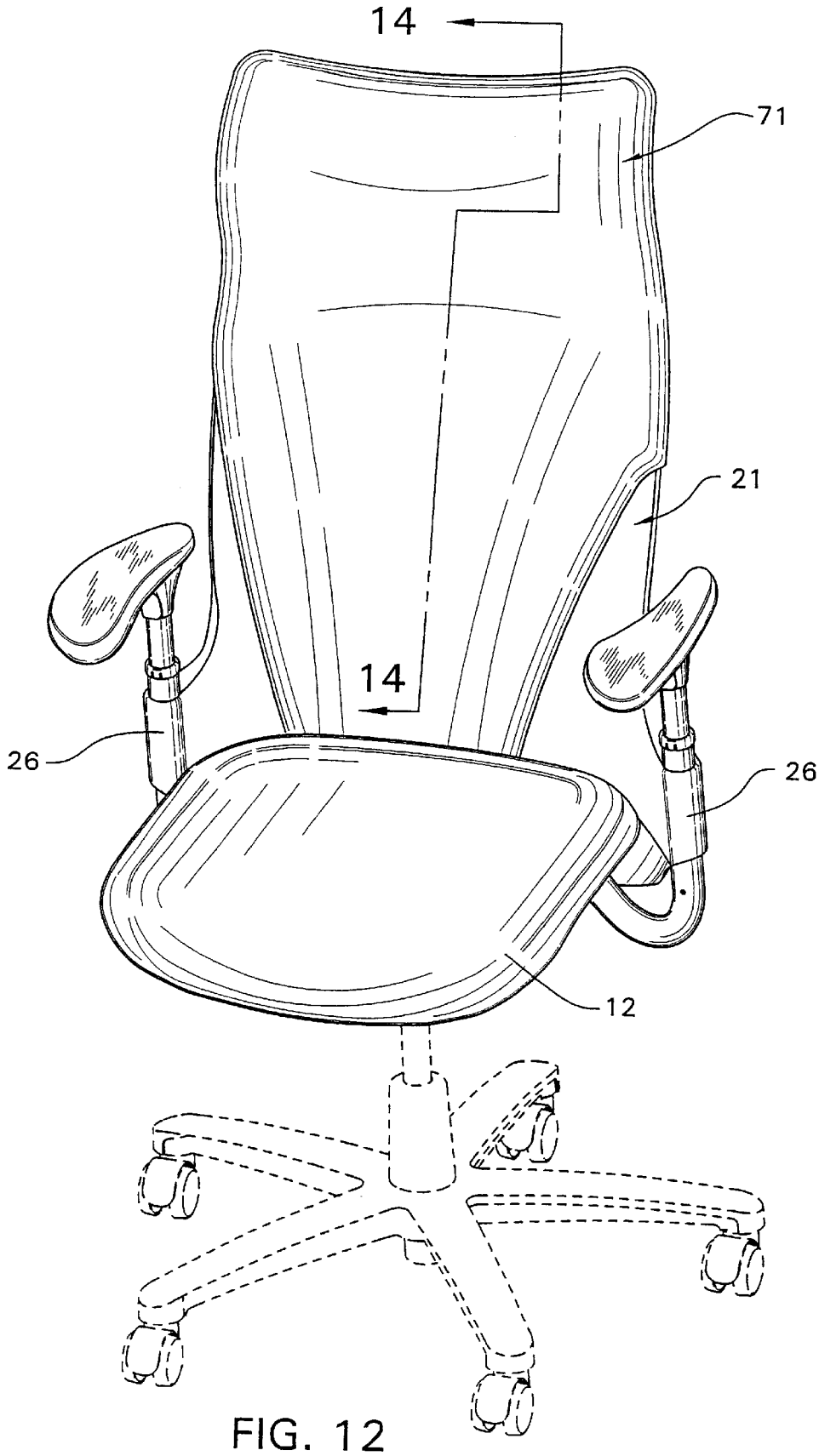
FIG. 12 is a perspective view of a chair similar to FIG. 2 but illustrating a variation of the pad unit mounted on the back shell.
Figure 13:
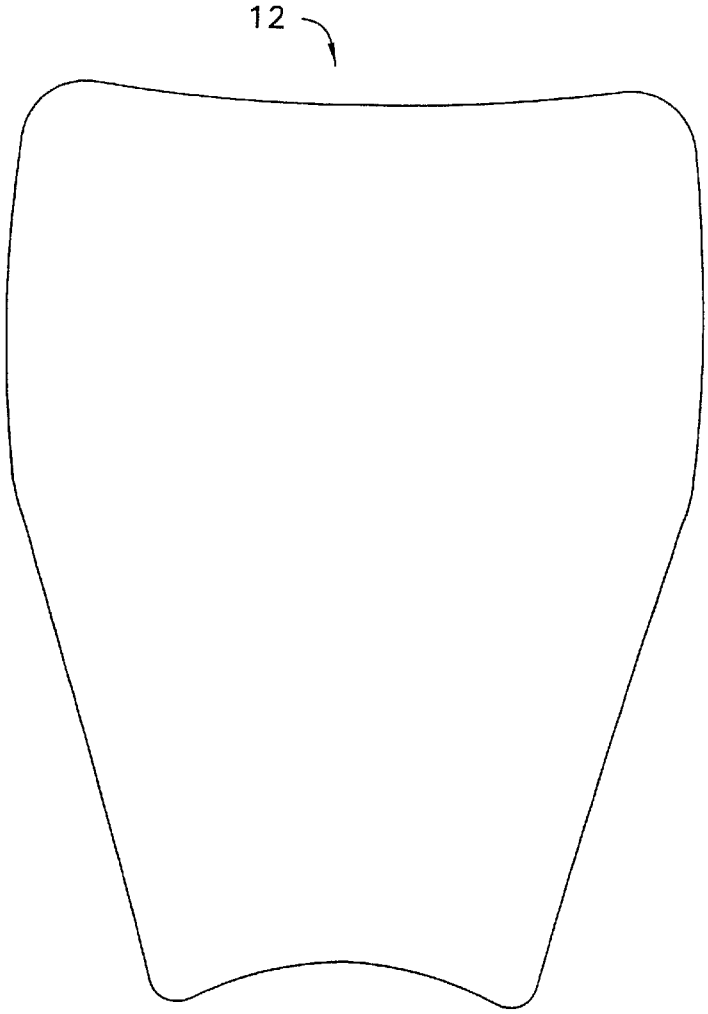
FIG. 13 is a front view of the pad unit of FIG. 12 but s own detached from the chair.

The pad shell 32 on the back side thereof, in the vicinity of the lower edge 52, has a protruding catch structure 69 (FIG. 11) which includes an opening 61 projecting through the shell and defining a clip receptor 62 internally thereof. This catch structure 69 is adapted to project into an opening 63 which is formed through the chair back shell 21 in the vicinity of the lower edge thereof, such as at an elevation generally corresponding to that of the chair seat, and a separate clip member 64 is used to secure the pad shell 32 to the chair back shell 21. This clip member 64 has an enlarged platelike head 66 provided with a male clip part 67 protruding outwardly from one side thereof, which latter clip part 67 is inserted from the rear side of the chair back shell opening 63 into the clip receptor 62 to create a snug snap-like fit to securely connect the shells. 32 and 21 together.

The pad unit 31 defined by the support shell 32, the intermediate cushioning layer 34 and the outer covering 36 is assembled as a fully integrated unit which can then be selectively and optionally attached in overlying relationship to the front face of a chair back shell 21, either prior to shipment from the supplier, or retrofitted onto the back shell at the point of use.

The attachment of the pad unit 31 to the chair back shell 21 will now be briefly described.

The pad unit 31 is positioned adjacent the front face of the chair back shell 21 but is disposed in slightly raised relationship relative to the upper edge of the chair back shell. When so disposed, the pad unit 31 is then slidably moved downwardly along the front face of the chair back shell 21 so as to cause the upper edge of the chair back shell to initially be inserted into the pocket 43 defined by the folded over covering flap 42. The continued downward movement of the pad unit 31 then causes the side securing flanges 58 to slidably engage around the upper portions of the side edges 24 of the chair back shell 21, with the downward displacement of the pad unit 31 continuing until the top securing flanges 57 engage with and seat on the upper edge 23 of the chair back shell 21. With the pad unit 31 properly seated on the chair back shell 21 as determined by engagement of the securing flanges 57 and 58 therewith, the protruding catch 69 associated with the lower part of the pad shell 32 aligns with and can be inserted into the opening 63 formed through the chair back shell 21. The securing clip member 64 is then positioned adjacent the rear face of the chair back shell 21 and the male clip part 67 is then inserted into the clip receptor 62 to create a snap-like engagement therewith, whereby the lower portion of the pad unit 31 is hence secured to the lower portion of the chair back shell 21.

Figure 2:
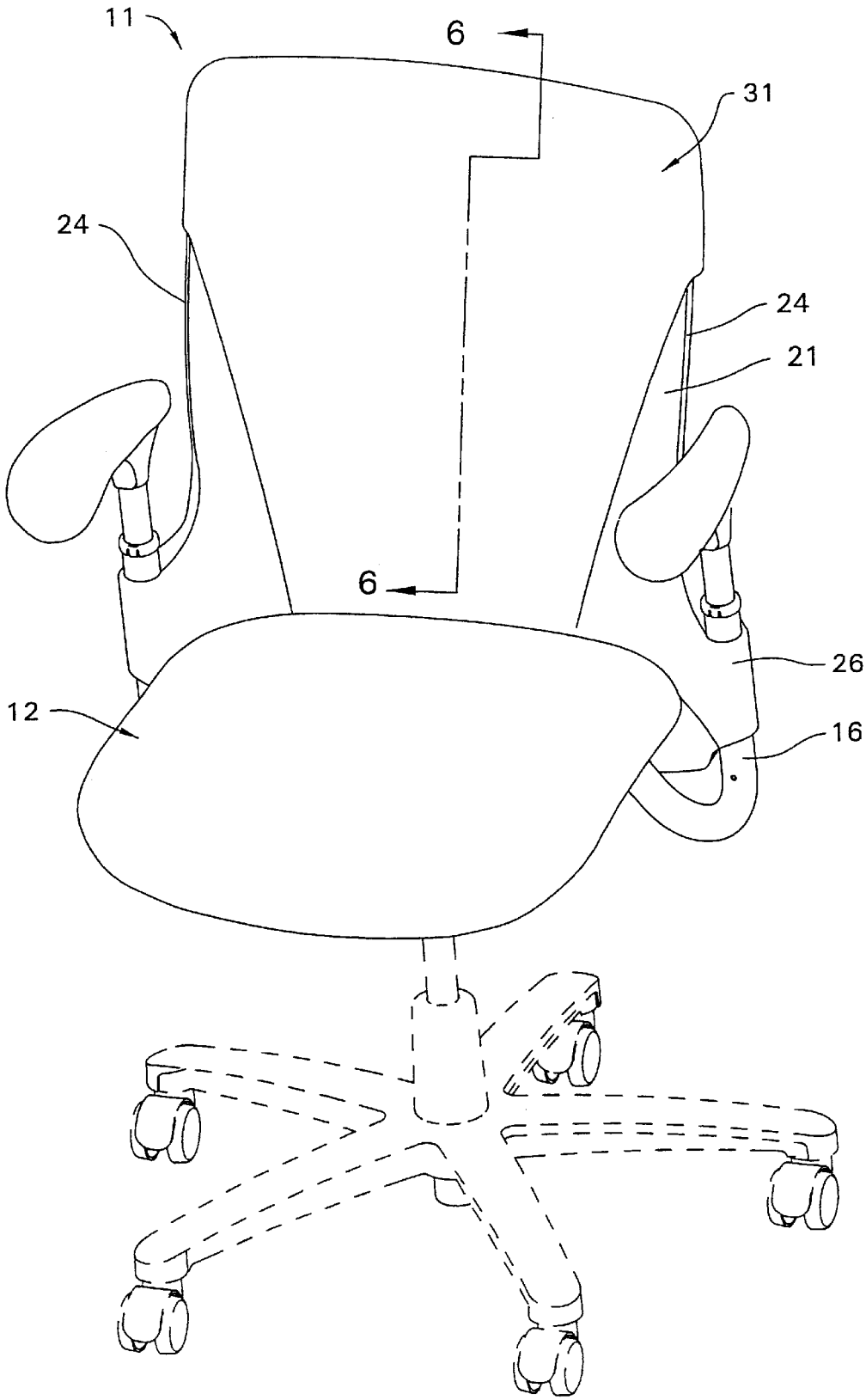
FIG. 2 is a perspective view of the chair shown in FIG. 1 and having a back pad unit optionally mounted on the back shell.
Figure 3:
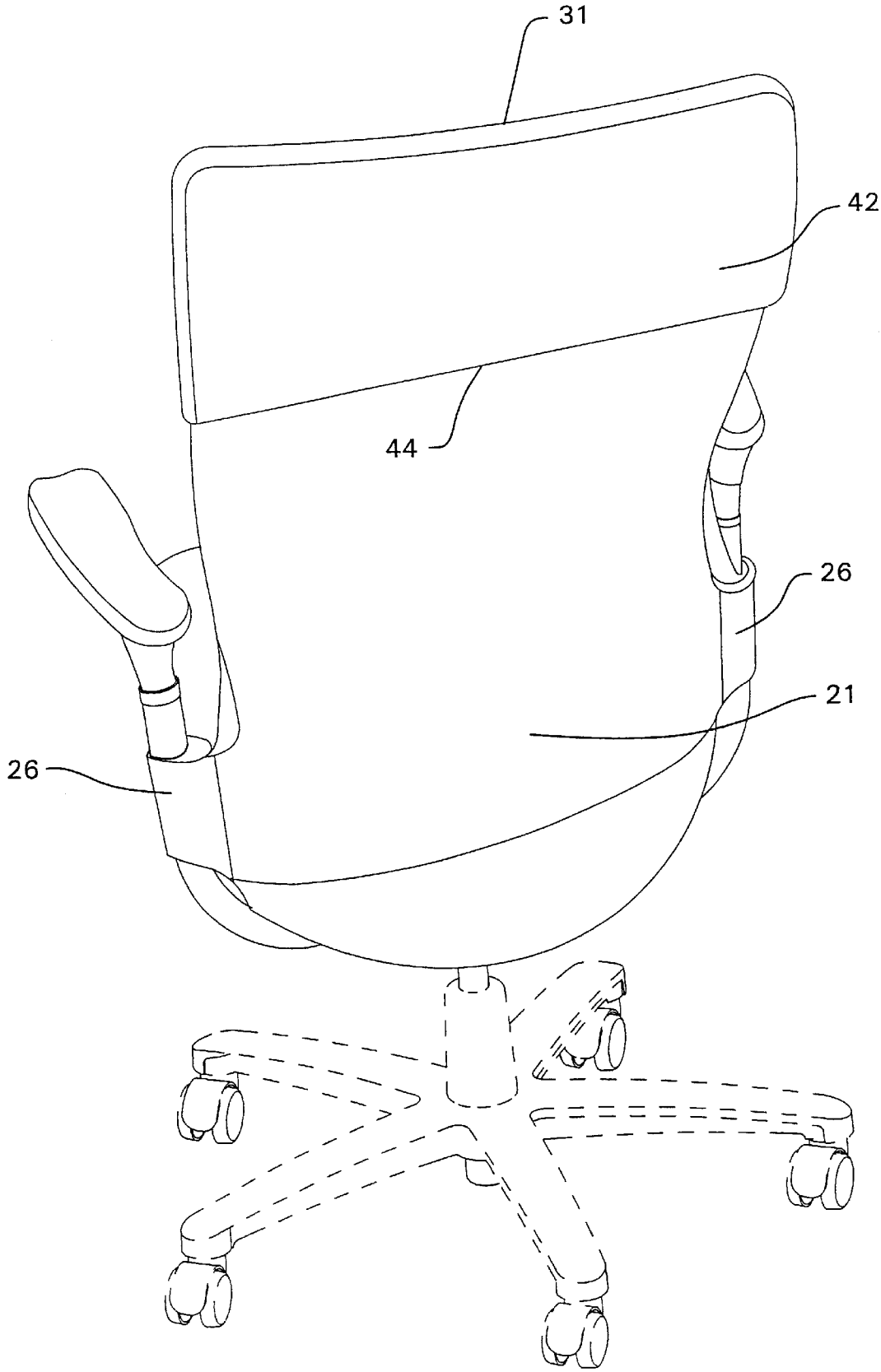
FIG. 3 is a rear perspective view of the chair shown in FIG. 1.
Figure 4:
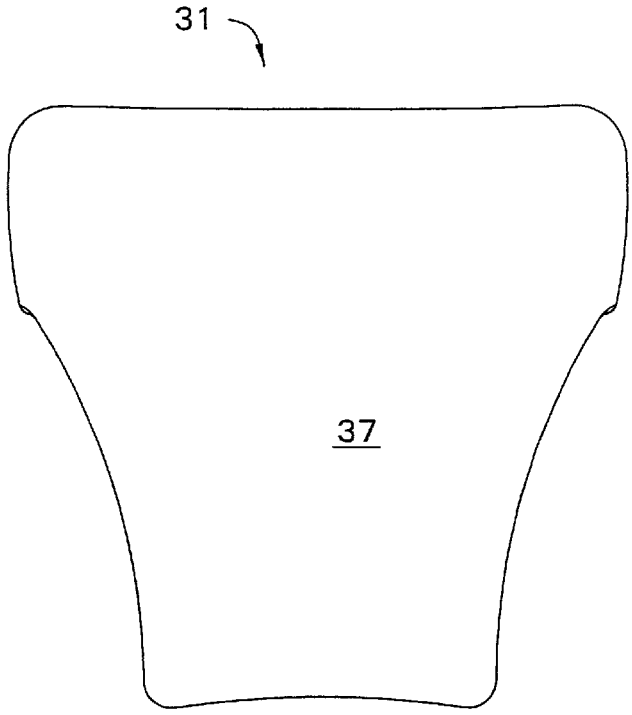
FIG. 4 is a front view of the back pad unit shown detached from the chair.
Figure 5:
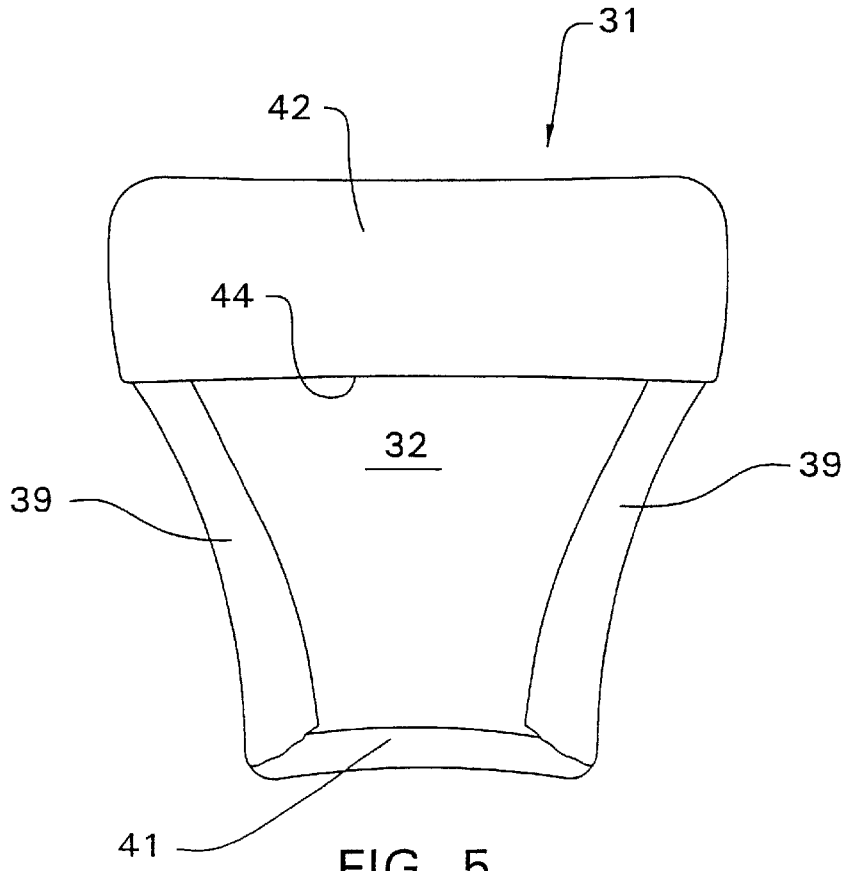
FIG. 5 is a rear view of the back pad unit shown in FIG. 4.
Figure 6:
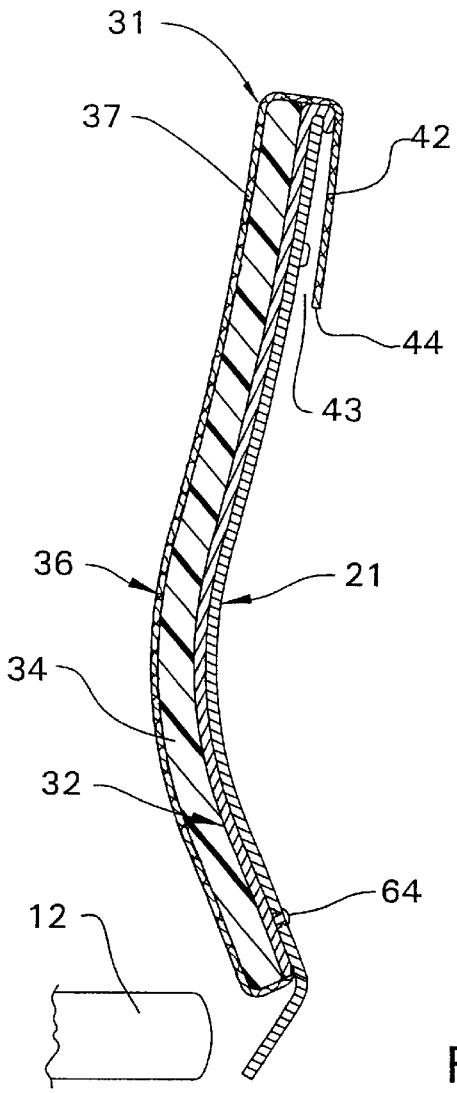
FIG. 6 is an enlarged fragmentary cross-sectional view taken generally along line 6—6 in FIG. 2.

With the pad unit 31 secured to the chair back shell 21, substantially as illustrated by FIGS. 2 and 3, the pad unit covers substantially the entirety of the front face of the chair back, and the pad unit also projects downwardly throughout the waist portion of the chair back so that an occupant of the chair can, when leaning rearwardly, experience contact with the cushioned back pad throughout substantially the full vertical extent of the chair back. The pad unit 31 in the illustrated embodiment, however, has the lower portion thereof, namely that portion which extends through the waist portion of the chair back, of lesser width than the chair back so that opposite side waist portions of the chair back, as defined on opposite sides of the waist portion of the pad unit, are visible and hence provide the chair with a different appearance as illustrated in FIG. 2. Since the pad unit is typically provided with some type of fabric or upholstery material as the outer covering, this configuration of the pad unit and the partial exposure of the chair back in the waist area thereof hence provides greater flexibility with respect to overall aesthetics of the chair.

Referring now to FIGS. 12–18, there is illustrated a variation of the preassembled pad unit 71 for a chair back according to the present invention. The preassembled pad unit 71 incorporates therein substantially all of the features associated with the pad unit 31 described above, and hence the parts of the modified pad unit 71 which correspond to the same parts of the pad unit 31 are designated by the same reference numerals, and will not again be described in detail.

The modified pad unit includes a main support panel or shell 72 which is also preferably constructed as a thin sheetlike member preferably of a plastics material and includes a main lower panel part 73 which is integrally joined to a smaller upper panel part 74. The lower panel part 73 is normally sized and shaped so as to substantially identically correspond to the support panel or shell 32 associated with the pad unit 31 as described above. However, the upper panel part is integrally joined to and projects upwardly from the lower panel part 73 so that the support shell 72 hence is of greater vertical extent and terminates at an upper edge 76 as defined on the upper panel part 74.

The upper panel part 74, in transverse vertical cross section, has a generally forwardly protruding profile 77 which defines a forwardly protruding rounded convex surface on the front side thereof, with this profile 77 defining a rounded concave recess on the rear side thereof. One or more reinforcing ribs 78 extend vertically across the recess defined in the rear of the protruding profile 77 to increase the strength and rigidity of the upper panel part 74. With the vertical upward extension of the support panel 72 caused by the inclusion of the upper panel part 74, the pad shell 72 hence has the top securing flanges 57 thereof spaced downwardly from the free upper edge 76, and in fact these securing flanges 57 are spaced vertically downwardly from the forwardly protruding profile 77 defined by the upper panel part 74.

Figure 14:
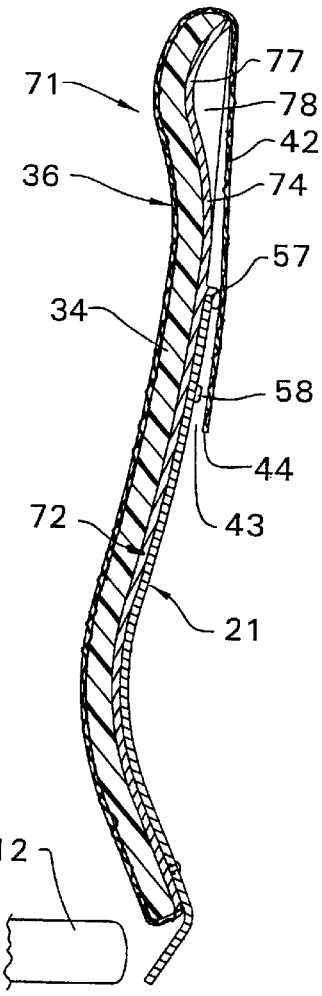
FIG. 14 is an enlarged fragmentary sectional view taken generally along line 14—14 in FIG. 12.
Figure 16:
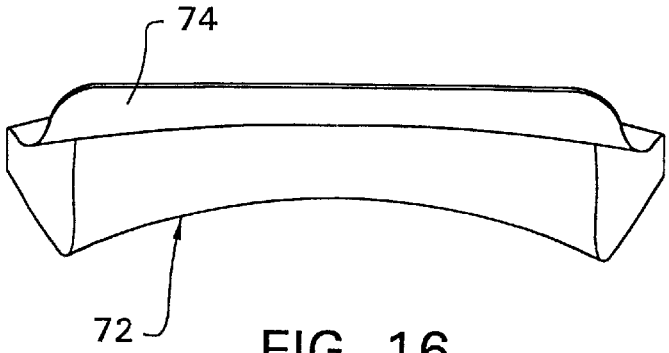
FIG. 16 is a top view of the pad shell shown in FIG. 15
Figure 15:
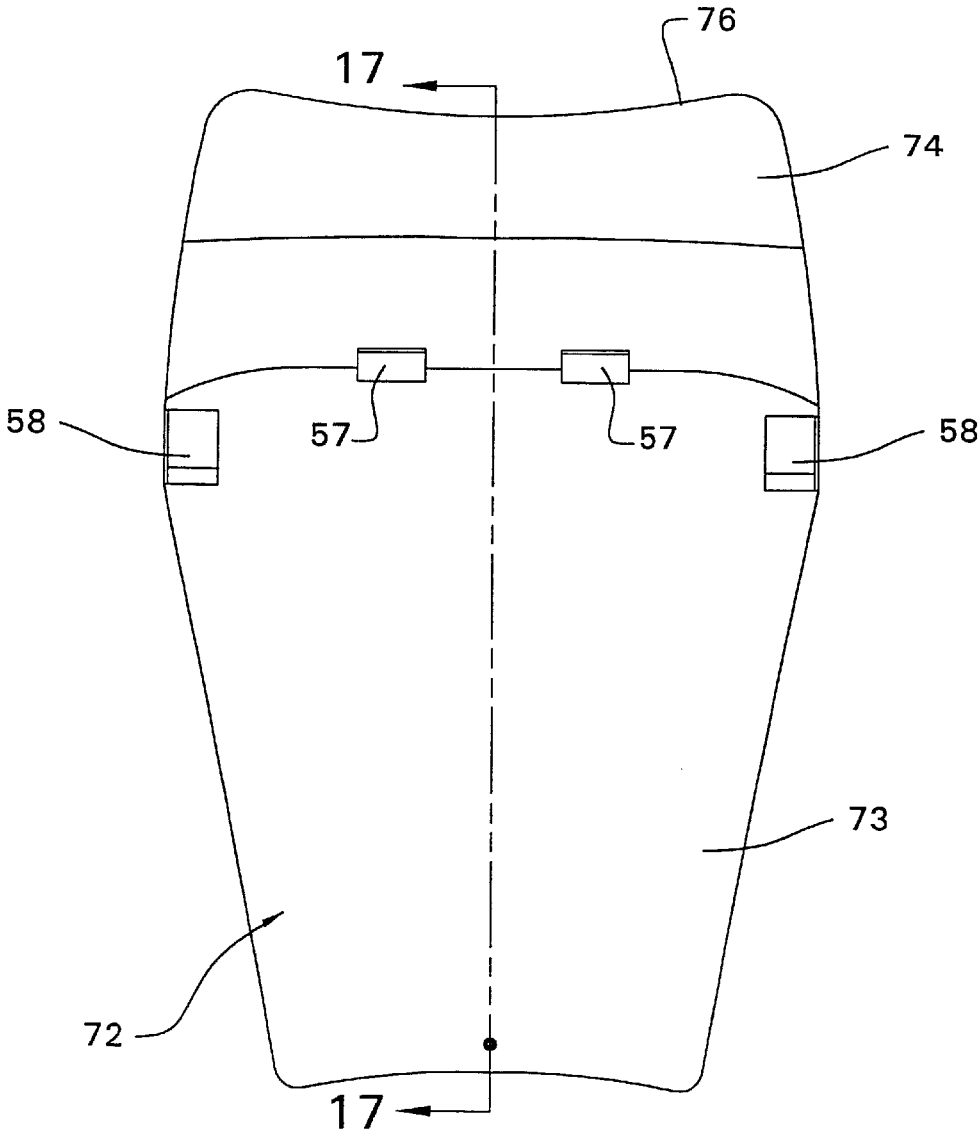
FIG. 15 is a front elevational view of the pad shell associated with the pad unit shown in FIGS. 12–14.
Figure 17:
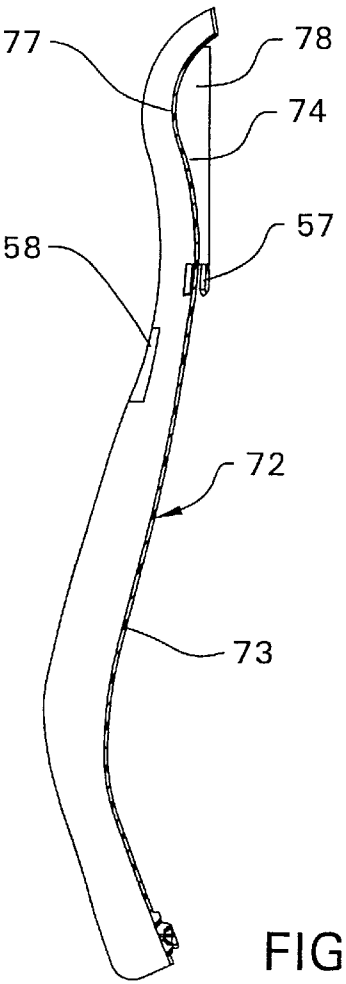
FIG. 17 is a sectional view taken along line 17—17 in FIG. 15.
Figure 18:
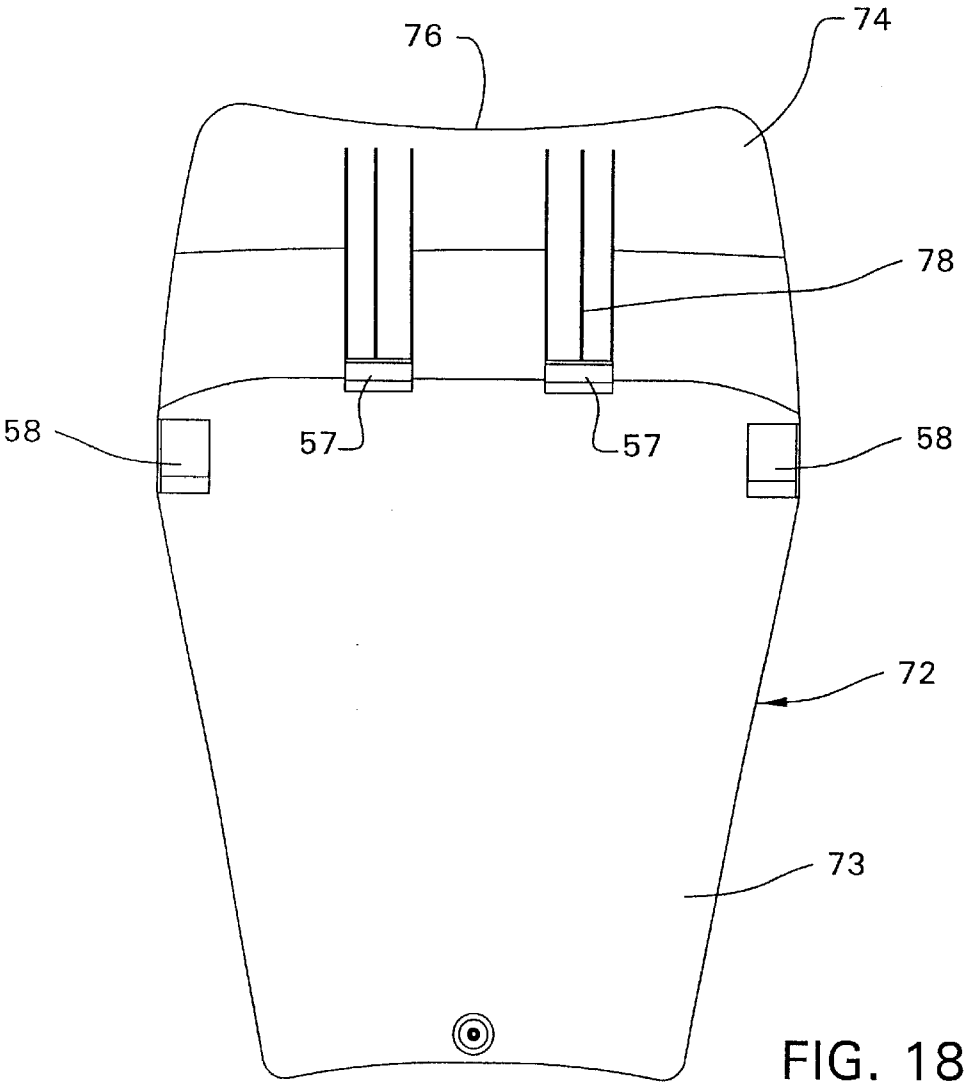
FIG. 18 is a back elevational view of the pad shell shown in FIG. 15.

Since the vertical extent of the pad panel shell 72 is increased by the presence of the upper panel part 74, the foam cushioning layer 34 is also vertically enlarged so as to overlie the full vertical extent of the front face of the panel member 72 as illustrated in FIG. 14, and the covering layer 36 is also enlarged so as to extend over the entire front face of the pad unit, with the size of the fold-over top flap 42 also being suitably enlarged so that the flap 42 when folded over so as to define the pocket 43 extends downwardly to an elevation at least below the side securing flanges 58.

The modified pad unit 71 is secured to the back shell 21 of the chair in the same manner as described above with respect to the pad unit 31. However, when the pad unit 71 is secured to the chair, the upper portion thereof as illustrated in FIG. 14 protrudes upwardly a substantial distance above the upper free edge 23 of the chair back shell 21. The upwardly protruding portion of the pad unit is defined by the upper panel part 74 and the cushioning and fabric layers which extend thereover, and the forwardly protruding rounded profile 77 associated with the upper panel part 74 enables the upper portion of the pad unit 71 to define a head rest for the seated occupant, which head rest is defined above the upper edge 23 of the chair back shell 21. In this manner the chair having a normal-height chair back shell 21, by attachment of the pad unit 71 thereto, can be converted into a chair having a higher-height back so as to effectively define a head rest integral with and adjacent the upper portion of the chair back arrangement.

The modified pad unit 71, like the pad unit 31 described above, can be easily fitted to the chair back either at the factory or retrofitted to the chair back at the work site.

If removal of the pad unit 31 or 71 from the chair is required for any reason, then the pad unit can be removed from the back shell by first removing the clip member 64, and thereafter slidably displacing the pad unit upwardly so as to disengage it from the chair back shell. While removal of the clip member 64 may cause some destruction or damage to the clip member, it will be appreciated that the pad unit can be remounted to the chair shell merely by obtaining a replacement clip member 64 if necessary.

With the chair pad arrangement of the present invention, the basic chair back shell 21 can be maintained free of openings or perforations, except for the small catch opening 63 provided through the lower portion of the back shell, and hence the overall aesthetics and appearance of the back shell remains clean and unencumbered for desirable usage when the back pad is not mounted thereon, and at the same time the shell accommodates mounting of the back pad without resulting in a significant number of visible fasteners and the like which destroy the appearance or aesthetics of the back shell.

Although particular preferred embodiments of the invention have been disclosed in detail for illustrative purposes, it will be recognized that variations or modifications of the disclosed apparatus, including the rearrangement of parts, lie within the scope of the present invention.

What is claimed is:

1. A chair, comprising:

a base supporting thereon a seat;

a non-cushioned chair back projecting upwardly from adjacent a rear edge of said seat;

a preassembled cushioned pad unit mounted on and positioned to overlie a front face of said chair back;

said pad unit including a thin sheetlike support panel, a cushioning layer overlying a front face of said support panel, and a thin sheetlike flexible covering overlying and enclosing the front face of said cushion and peripheral edges of said cushion and said support panel;

said covering including a rear flap part which folds over an upper edge of the cushioning layer and back panel and which overlies an upper portion of a back surface of said support panel to define a downwardly-opening pocket therebetween;

said support panel having a pair of opposed, rearwardly and inwardly projecting securing flanges mounted on opposite sides thereof for engagement with opposite side edge portions of said chair back to fixedly connect said pad unit to said chair back;

said support panel also including a positioning flange fixed to and projecting rearwardly therefrom for engagement with an upper edge of said chair back when the pad unit is mounted thereon; and said securing and positioning flanges being positioned so as to be enclosed by said rear flap part of said covering.

2. A chair according to claim 1, wherein said side flanges are generally L-shaped and cooperate with the rear surface of said support panel to define slots which accommodate the side edge portions of the chair back therein.

3. A chair according to claim 2, wherein the positioning flange is L-shaped and projects rearwardly and downwardly and cooperates with the back surface of the support panel to define a downwardly-opening slot which accommodates an upper edge portion of the chair back therein.

4. A chair according to claim 3, wherein said positioning flange is fixed to an upper edge of said support panel.

5. A chair according to claim 3, wherein a snap-type catch is provided adjacent a lower edge of said support panel for fixedly coupling the pad unit in overlying relationship to a front face of the chair back.

6. A chair according to claim 3, including a separate fastener for coupling the pad unit and chair back together adjacent a lower edge thereof.

7. A chair according to claim 3, wherein the chair back is constructed of a sheetlike plastics material; having at least limited flexibility and an upper portion thereof is provided with three-dimensional contouring, and wherein said support panel of the pad unit is constructed of sheetlike plastics material and has a contour which enables it to substantially conform to the front face of the chair back.

8. A chair according to claim 7, wherein an upper portion of said chair back is free of perforations or openings therethrough.

9. A chair according to claim 7, wherein the support panel includes an upper part which projects upwardly from said positioning flange and defines an upper free edge of said pad unit, said upper part projecting upwardly above the upper edge of said chair back when the pad unit is mounted thereon so as to function as a head rest for a seated occupant.

10. A chair according to claim 9, wherein the upper part of the support panel has a curved and forwardly protruding shape which is covered by said cushioning layer and said flexible covering, and also has a vertical reinforcing rib fixed to a rear side thereof.

11. A chair according to claim 1, wherein the, support panel includes an upper part which projects upwardly from said positioning flange and defines an upper free edge of said pad unit, said upper part projecting upwardly above the upper edge of said chair back when the pad unit is mounted thereon so as to function as a head rest for a seated occupant.

12. A chair according to claim 11, wherein the upper part of the pad panel has a curved and forwardly protruding shape which is covered by said cushioning layer and said flexible covering, and also has a vertical reinforcing rib fixed to a rear side thereof.

13. A chair comprising:

a base supporting a seat thereon;

a non-cushioned back member projecting upwardly from adjacent a rear edge of said seat and terminating in an upper edge, said back member defining thereon a contoured front face adapted for engagement with a seated occupant of the chair;

a preassembled cushioned pad unit mounted on said back member and positioned to overlie at least a part of the front face thereof;

said pad unit including a thin sheetlike support panel, a cushioning layer overlying a front face of the support panel, and a thin sheetlike flexible covering overlying and enclosing a front face of the cushioning layer and peripheral edges of the cushioning layer and support panel;

said pad unit including upper and lower portions which cooperate with the back member, when the pad unit is mounted thereon, such that the lower portion overlies the front face of the back member whereas the upper portion of the pad unit projects upwardly a significant vertical extent beyond the upper edge of the back member so as to function as a head rest;

said support panel having flanges fixed thereto and projecting rearwardly therefrom for engagement with peripheral edge portions of said back member for securely positioning and mounting said panel unit on said back member; and said covering including an enlarged rear flap which folds over an upper edge of the pad unit so as to overlie a back surface of the upper portion of said support panel as well as part of the back surface of the lower portion of said back panel, said rear flap cooperating with said back surface to define a downwardly-opening pocket therebetween for accommodating an upper portion of the back member therein, said flap also overlying and enclosing said flanges.

14. A chair according to claim 13, wherein the upper portion of the support panel has a rounded and outwardly protruding curvature in vertical cross section so as to function as a head rest.

15. A chair according to claim 14, wherein the rounded and forwardly protruding configuration of the upper portion of the support panel defines a concave recess associated with a rear face thereof, and a plurality of vertically extending reinforcing ribs being integrally joined to said upper portion and extending vertically across said recess for increasing the rigidity of the upper portion.

16. A chair according to claim 14, wherein the support panel includes a pair of said flanges exposed on opposite sides thereof and positioned for gripping engagement with opposite side edge portions of the back member in the vicinity of the upper edge thereof, said support panel also having a positioning flange which is spaced upwardly from said side flanges and is disposed for engagement with the upper edge of the back member when the pad unit is mounted thereon, said positioning flange being spaced vertically downwardly a substantial distance from an upper edge of said support panel.

17. A cushioned pad for retrofitting to and disposition in front of a non-cushioned chair back, said pad member comprising:

a thin sheetlike support panel having a contoured rear surface adapted to conform to the contour of the back member;

a layer of cushioning material positioned substantially coextensively over a front surface of said support panel;

a thin flexible covering sheet positioned to extend substantially coextensively over a front surface of said cushioning layer, said covering sheet having edge portions which wrap around peripheral edges of the covering layer and support panel;

said covering layer including a rear flap part which wraps around an upper edge of said support panel and projects downwardly a significant vertical extent and overlies an upper portion of the rear surface of said support panel, said rear flap part along side edges thereof being secured relative to the support panel while a lower free edge of the rear flap part is free of securement so as to provide access to a downwardly-opening pocket defined between said rear flap part and the rear surface of said support panel;

a securing flange structure fixed to and projecting rearwardly from said support panel, said flange structure cooperating with the rear face of the support panel to define a slot which snugly accommodates therein an edge portion of the back member for permitting secure positioning of the panel unit on the back member; and said flange structure being disposed beneath and covered by said rear flap part.

18. A pad unit according to claim 17, wherein said mounting flange structure includes a pair of opposed side flanges which are fixed to opposite sides of said support panel and which project inwardly in opposed relationship for gripping engagement with opposite side portions of the back member, said flange structure also including a part which projects rearwardly for engagement with an upper edge of the chair back when the pad unit is mounted thereon to vertically position the pad unit relative to the chair back.

19. A pad unit according to claim 18, wherein the positioning flange is secured to the support pad adjacent an upper edge thereof and projects rearwardly and downwardly therefrom to define a slot which accommodates therein an upper edge portion of the back member when the pad unit is mounted thereon such that an upper edge of the pad unit is disposed in close proximity to the upper edge of the back member.

20. A pad unit according to claim 17, wherein the support panel includes upper and lower parts, the lower part having the back surface thereof configured to conform to and overlie the front face of the back member, the upper part projecting upwardly above the upper edge of the chair back when the pad unit is mounted thereon, said upper part having a contour so as to function as a head rest, said cushioning layer and said covering extending coextensively over the front face of said upper part and said rear flap part extending downwardly so as to overlap the rear surface of the upper part as well as an upper portion of the rear surface of the lower part.

* * * * *

UNITED STATES PATENT AND TRADEMARK OFFICE

CERTIFICATE OF CORRECTION

PATENT NO. : 6,726,278 B1
DATED : April 27, 2004
INVENTOR(S) : Scott Albright et al.

It is certified that error appears in the above-identified patent and that said Letters Patent is hereby corrected as shown below:

Column 8,
Line 10, after "material" delete ";".
Line 29, after "the" delete ",".

Signed and Sealed this

Fifth Day of October, 2004

JON W. DUDAS
*Director of the United States Patent and Trademark Office*